US008413465B2

(12) United States Patent
Pei

(10) Patent No.: US 8,413,465 B2
(45) Date of Patent: Apr. 9, 2013

(54) FIXING DEVICE AND GLASS MANUFACTURING DEVICE

(75) Inventor: Shao-Kai Pei, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 182 days.

(21) Appl. No.: 12/916,616

(22) Filed: Oct. 31, 2010

(65) Prior Publication Data

US 2012/0048475 A1 Mar. 1, 2012

(30) Foreign Application Priority Data

Aug. 27, 2010 (TW) ..... 099128942 A

(51) Int. Cl.
*C03C 19/00* (2006.01)
*B24C 3/00* (2006.01)

(52) U.S. Cl. ..... 65/61; 65/138

(58) Field of Classification Search ..... 65/61, 138–140, 65/287; 451/29–31, 41–44, 75–102, 38
See application file for complete search history.

(56) References Cited

U.S. PATENT DOCUMENTS

| | | | | |
|---|---|---|---|---|
| 2,106,981 | A * | 2/1938 | Kavanaugh | 451/442 |
| 2,156,696 | A * | 5/1939 | Knox | 451/31 |
| 4,133,919 | A * | 1/1979 | Parsons | 427/259 |
| 6,099,395 | A * | 8/2000 | Guseman | 451/75 |
| 6,533,643 | B1 * | 3/2003 | Feng | 451/29 |
| 2004/0072493 | A1 * | 4/2004 | Fujinaga et al. | 445/24 |
| 2010/0221565 | A1 * | 9/2010 | Skeeter | 428/542.2 |
| 2011/0312252 | A1 * | 12/2011 | Pei | 451/38 |
| 2012/0015591 | A1 * | 1/2012 | Pei | 451/89 |
| 2012/0031147 | A1 * | 2/2012 | Arai et al. | 65/182.2 |
| 2012/0064807 | A1 * | 3/2012 | Pei | 451/89 |
| 2012/0077423 | A1 * | 3/2012 | Pei | 451/89 |
| 2012/0088437 | A1 * | 4/2012 | Pei | 451/5 |

FOREIGN PATENT DOCUMENTS

| | | | |
|---|---|---|---|
| DE | 3911356 | A1 * | 10/1990 |
| JP | 01163979 | A * | 6/1989 |
| JP | 2001328070 | A * | 11/2001 |

* cited by examiner

*Primary Examiner* — Jodi C Franklin
(74) *Attorney, Agent, or Firm* — Altis Law Group, Inc.

(57) ABSTRACT

A glass manufacturing device includes a main body defining a working space, a fixing device and a grit blower in communication with the working space. The fixing device includes a first fixing assembly, a second fixing assembly, and a locking assembly. The first and second fixing assemblies are rotatably connected with each other and used for clamping a glass substrate. The first fixing assembly includes a number of shielding elements spaced from each other. The locking assembly is used for locking the first and second fixing assemblies. The grit blower is disposed opposite to the first fixing assembly and used for blasting grit on the glass substrate, and thus the portions of the glass substrate which are not shielded by the shielding elements are cut off during the process of grit-blasting. Remaining portions of the glass substrate shielded by the shielding elements are the desired product.

7 Claims, 4 Drawing Sheets

FIXING DEVICE AND GLASS MANUFACTURING DEVICE

BACKGROUND

1. Technical Field

The present disclosure relates to a fixing device and a glass manufacturing device using the fixing device.

2. Description of Related Art

Methods for glass manufacturing often include cutting a glass substrate into a number of preforms of the same shape and size; adhering the preforms together using ultraviolet (UV) glue; grinding edges of the preforms to obtain workpieces of a desired shape and size; and removing the UV glue to separate the workpieces, a complicated and time-consuming process.

Therefore, it is desirable to provide a fixing device and a glass manufacturing device using the same that can overcome the described limitations.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
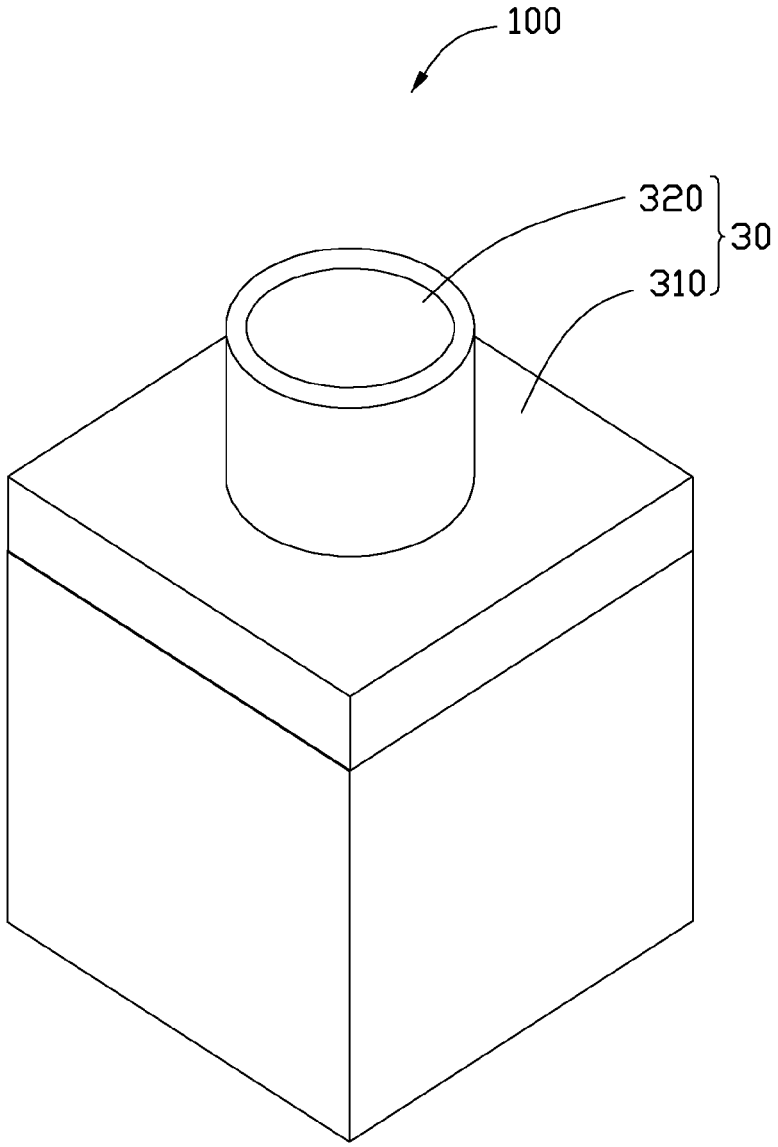
FIG. 1 is a schematic view of a glass manufacturing device, according to an exemplary embodiment.
Figure 2:
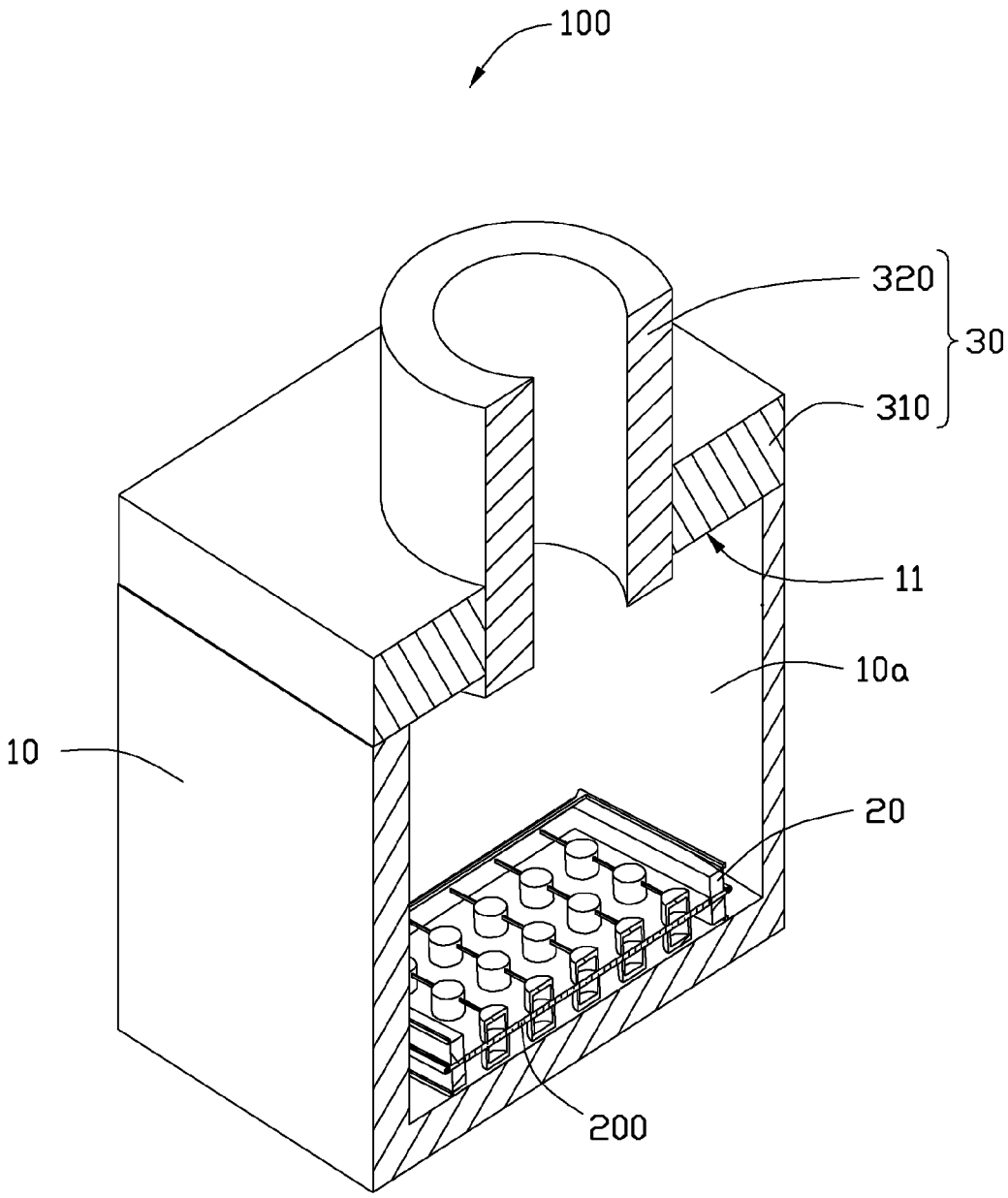
FIG. 2 is a cross-section of the glass manufacturing device of FIG. 1.

Referring to FIG. 1 and FIG. 2, a glass manufacturing device 100, according to an exemplary embodiment, includes a main body 10, a fixing device 20, and a grit blower 30. The main body 10 defines a working space 10*a*. The fixing device 20 is received in the working space 10*a*.

Both the main body 10 and the working space 10*a* are substantially cubic. The main body 10 also defines a rectangular opening 11 communicating the working space 10*a* to the exterior. The fixing device 20 can be placed into the working space 10*a* from the opening 11. The grit blower 30 hermetically seals the opening 11 to face the fixing device 20.

Figure 3:
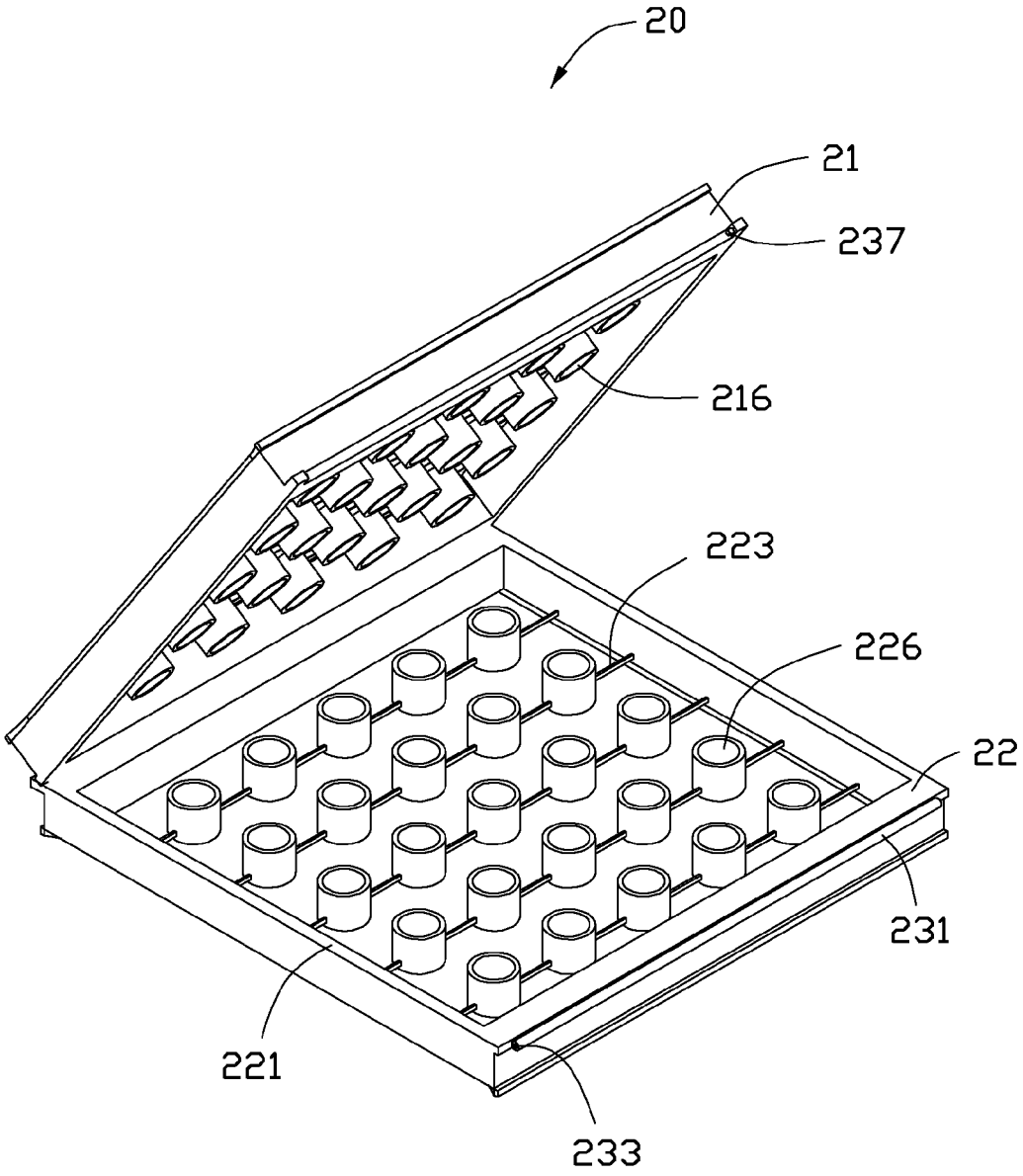
FIG. 3 is a schematic view of a fixing device of the glass manufacturing device of the FIG. 1.
Figure 4:
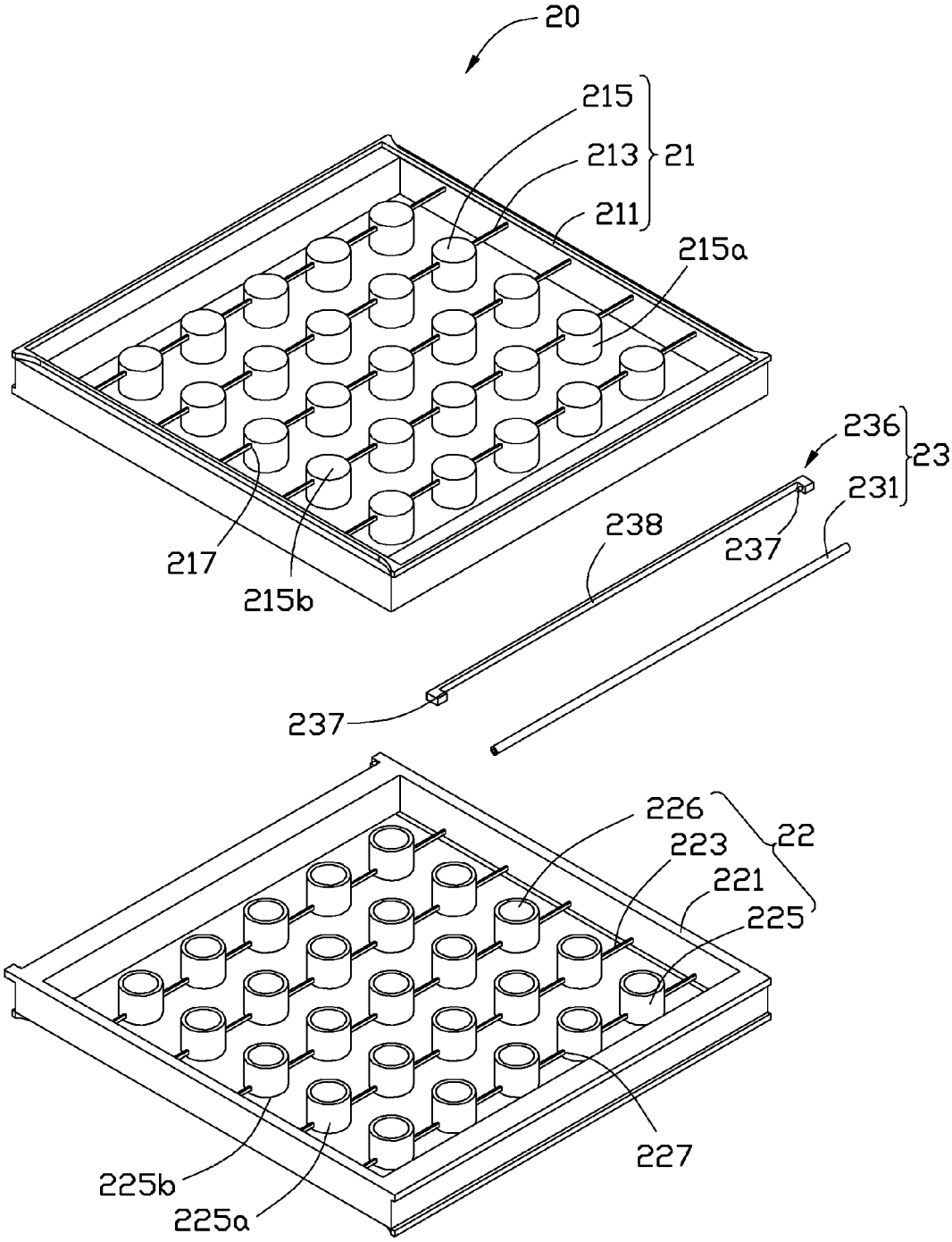
FIG. 4 is an exploded view of the fixing device of FIG. 3.

The fixing device 20 is arranged on the bottom of the working space 10*a* and used for fixing a glass substrate 200 thereon. Referring to FIG. 3 and FIG. 4, the fixing device 20 includes a first fixing assembly 21, a second fixing assembly 22, and a locking assembly 23. The second fixing assembly 22 is pivotally connected to the first fixing assembly 21. The first fixing assembly 21 faces the top of the working space 10*a*. The second fixing assembly 22 faces the bottom of the working space 10*a*. The glass substrate 200 is disposed between the first and second fixing assemblies 21, 22. In this embodiment, the glass substrate 200 is rectangular. In other embodiments, the glass substrate 200 can be other geometrical shapes.

The first fixing assembly 21 includes a first fixing frame 211, a number of first fixing posts 213, and a number of first shielding elements 215. The first shielding elements 215 are arranged in an array and fixed to the first fixing frame 211 via the first fixing posts 213 arranged in an array to interconnect the first shielding elements 215 and the first fixing frame 211. Each first shielding element 215 includes a tubular first sidewall 215*a* and a first shielding plate 215*b* sealing one opened end of the first sidewall 215*a*, which is distant from the second fixing assembly 22 and used for shielding the glass substrate 200. The first sidewall 215*a* defines a first through hole 217 extending substantially parallel to the first shielding plate 215*b*. The first through holes 217 interferingly receive the corresponding first fixing posts 213, by which the first shielding elements 215 are connected to the first fixing frame 211. The first shielding plate 215*b* and the first sidewall 215*a* cooperatively define a first groove 216.

The second fixing assembly 22 includes a second fixing frame 221, a number of second fixing posts 223, and a number of second shielding elements 225. The second shielding elements 225 are arranged in an array and fixed to the second fixing frame 221 via the second fixing posts 223 arranged in an array to interconnect the second shielding elements 225 and the second fixing frame 221. Each second shielding element 225 includes a tubular second sidewall 225*a* and a second shielding plate 225*b* sealing one opened end of the second sidewall 225*a*, which is distant from the first fixing assembly 21 and used for shielding the glass substrate 200. The second sidewall 225*a* defines a second through hole 227 extending substantially parallel to the second shielding plate 225*b*. The second through holes 227 interferingly receive the corresponding second fixing posts 223, and the second shielding elements 225 are thus connected to the second fixing frame 221 via the second fixing posts 223. The second shielding plate 225*b* and the second sidewall 225*a* cooperatively define a second groove 226.

The first and second shielding elements 215, 225 are rigid metal such as iron, and thus not easily affected by grit from the grit blower 30.

The locking assembly 23 is used for locking the first and second fixing assemblies 21, 22 and includes a first locking element 231 and a second locking element 236. The first locking element 231 is fixed on a surface of the first fixing frame 211. The second locking element 236 is fixed on a surface of the second fixing frame 221 corresponding to the first locking element 231. In this embodiment, the first locking element 231 is a post defining a blind-hole 233 in each end surface thereof. The second locking element 232 is a rod that defines a cutout 238 corresponding to the first locking element 231. That is, the first locking element 231 can be fittingly received in the cutout 238. The second locking element 236 includes two opposite pins 237 extending toward each other from two ends of the cutout 238. The two pins 237 can be received in the two blind-holes 233 respectively to lock the first and second fixing frames 211, 221. The two pins 237 are flexible material (such as teflon), and thus the two pins 237 can be pulled along two opposite directions to move the two pins 237 from the two bind-holes 233 to separate the first and second fixing frames 211, 221. In other embodiments, the first and second locking elements 231, 236 can also be a ring and a shaft respectively.

Referring back to FIGS. 1-2, the grit blower 30 includes a fixing plate 310 and a jet 320. The fixing plate 310 hermetically seals the opening 11. The jet 320 extends through the top and bottom surfaces of the fixing plate 310 and into the working space 10*a*, where it expels grit onto the glass substrate 200 to cut the glass substrate 200 so as to form a number of glass products. In this embodiment, the fixing plate 310 is rectangular, corresponding to the shape of the opening 11.

In use, the glass substrate 200 is fixed between the first and second shielding elements 215, 225. The locking assembly 23 locks the first and second fixing frames 211, 221. The fixing plate 310 hermetically seals the working space 10*a*. The grit blower 30 blasts grit from the jet 320 onto the glass substrate 200 until the portions of the glass substrate 200 not shielded by the first shielding plate 215*b* are cut. Remaining portions of the glass substrate 200 shielded by the first shielding elements 215 are the desired product. The area of each glass product is equal to the corresponding first shielding element 215. It can be understood that the area of the first shielding elements 215 can be different to obtain different area of glass product.

In this embodiment, the first and second shielding elements 215, 225 are columnar. In other embodiments, the first and second shielding elements 215, 225 can alternatively be other shapes.

In this embodiment, the first and second shielding elements 215, 225 are arranged in an array respectively, with each first and second shielding plate 215*b*, 225*b* circular. In other embodiments, the first and second shielding elements 215, 225 can be arranged otherwise, and each first and second shielding plate 215*b*, 225*b* can be of other geometrical shape.

In other embodiments, the second fixing assembly 22 can also be a plane plate defining a number of second grooves corresponding to the first shielding elements 215.

The shape and area of the first shielding plate 215*b* can also be different from that of the second shielding plate 225*b*. If the second shielding plate 225*b* is smaller than the first shielding plate 215*b*, the fixing device 20 can also be fixed on a bracket to prevent the grit rebounded by the bottom of the working space 10*a* from reaching the glass substrate 200.

In other embodiments, other fixing means can also be used for fixing the first fixing posts 213 on the first fixing frame 211, such as the two inner surfaces of the first fixing frame 211 defining a number of holes in which the two ends of the first fixing posts 213 are interferingly received.

In other embodiments, other fixing means can also be used for fixing the second fixing posts 223 on the second fixing frame 221.

Because the grit impacts the glass substrate 200, the fixing device 20 can vibrate, and if the first and second shielding elements 215, 225 do not define the first and second grooves 216, 226, the first and second shielding plates 215*b*, 225*b* will impact the glass substrate 200. If a shockproof device is used to reduce vibration of the fixing device 20, the first and second grooves 216, 226 can also be omitted.

It will be understood that the above particular embodiments are shown and described by way of illustration only. The principles and the features of the present disclosure may be employed in various and numerous embodiments thereof without departing from the scope of the disclosure as claimed. The above-described embodiments illustrate the scope of the disclosure but do not restrict the scope of the disclosure.

What is claimed is:

1. A fixing device for fixing a glass substrate, comprising:

a first fixing assembly comprising:

a first fixing frame;

a plurality of first shielding elements spaced from each other, wherein each first shielding element has a first shielding plate and a tubular first sidewall, the first shielding plate seals one opened end of the tubular first sidewall, the tubular first sidewall defines a first through hole extending substantially parallel to the first shielding plate; and a plurality of first fixing posts positioned on the first fixing frame, wherein each first fixing post is interferingly received in the corresponding first through hole, the first shielding elements are thus fixed on the first fixing posts correspondingly;

a second fixing assembly rotatably connected to the first fixing assembly and configured to cooperatively clamp the glass substrate with the first fixing assembly; and a locking assembly comprising a first locking element positioned on the first fixing assembly and a second locking element positioned on the second fixing assembly, the first locking element configured to engage with the second locking element to lock the first fixing assembly to the second fixing assembly.

2. The fixing device of claim 1, wherein the first shielding plate and the tubular first sidewall of each first shielding element cooperatively define a first groove.

3. The fixing device of claim 1, wherein the second fixing assembly comprises a plurality of second shielding elements corresponding to the first shielding elements.

4. The fixing device of claim 3, wherein the second fixing assembly comprises a second fixing frame and a plurality of second fixing posts positioned on the second fixing frame, each second shielding element comprises a tubular second sidewall, the tubular second sidewall defines a second through hole extending substantially parallel to the second shielding plate, each second fixing post is interferingly received in the corresponding second through holes, the second shielding elements are thus fixed on the second fixing posts correspondingly.

5. The fixing device of claim 4, wherein each second shielding element comprises a second shielding plate sealing one opened end of the tubular second sidewall, the second shielding plate and the tubular second sidewall of each second shielding element cooperatively define a second groove.

6. The fixing device of claim 1, wherein the first locking element comprises at least one pin, the second locking element comprises at least one post, the at least one post defines a blind-hole corresponding to the at least one pin.

7. The fixing device of claim 6, wherein the pin is made of flexible material.

* * * * *